US010204554B2

(12) United States Patent
Liu

(10) Patent No.: US 10,204,554 B2
(45) Date of Patent: Feb. 12, 2019

(54) PIXEL COMPENSATION CIRCUIT AND DISPLAY DEVICE

(71) Applicant: Wuhan China Star Optoelectronics Semiconductor Display Technology Co., LTd., Wuhan, Hubei (CN)

(72) Inventor: Jie Liu, Guangdong (CN)

(73) Assignee: Wuhan China Star Optoelectronics Semiconductor Display Technology Co., Ltd., Wuhan. Hubei (CN)

( * ) Notice: Subject to any disclaimer, the term of this patent is extended or adjusted under 35 U.S.C. 154(b) by 0 days.

(21) Appl. No.: 15/554,220

(22) PCT Filed: Jul. 14, 2017

(86) PCT No.: PCT/CN2017/092923

§ 371 (c)(1),
(2) Date: Aug. 29, 2017

(65) Prior Publication Data

US 2019/0005876 A1 Jan. 3, 2019

(51) Int. Cl.
*G09G 3/30* (2006.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2310/061* (2013.01); *G09G 2320/045* (2013.01)

(58) Field of Classification Search
CPC .. G09G 3/3208; G09G 3/3225; G09G 3/3233; G09G 3/3258
See application file for complete search history.

(56) References Cited

U.S. PATENT DOCUMENTS

| | | | | |
|---|---|---|---|---|
| 9,349,324 | B2 | 5/2016 | Chang et al. | |
| 9,601,057 | B2 | 3/2017 | Liu et al. | |
| 2009/0109150 | A1* | 4/2009 | Han | G09G 3/3233 345/82 |
| 2009/0219232 | A1* | 9/2009 | Choi | G09G 3/3233 345/76 |
| 2012/0013597 | A1* | 1/2012 | Han | G09G 3/3233 345/212 |
| 2014/0292740 | A1 | 10/2014 | Tseng | |

FOREIGN PATENT DOCUMENTS

| | | | |
|---|---|---|---|
| CN | 102982766 | A | 3/2013 |
| CN | 105913801 | A | 8/2016 |

* cited by examiner

*Primary Examiner* — Roy P Rabindranath
(74) *Attorney, Agent, or Firm* — Andrew C. Cheng

(57) ABSTRACT

A pixel compensation circuit and a display are provided. First, third, fourth, and fifth switches include control terminals coupled to a light-emitting control terminal, a control signal, a first scanning signal and a second scanning signal, respectively. A second switch includes a control terminal connected to the second terminal of the second switch. A driving switch includes a control terminal connected to the second terminal of the third switch, a first terminal connected to the second terminal of the first switch, and a second terminal coupled to a second terminal of the fourth switch. The fifth switch includes a second terminal coupled to an anode of the OLED. The second terminal of the second switch is coupled to the second terminal of the third switch via a first capacitor. The second terminal of the second switch is coupled to a second reset signal via a second capacitor.

11 Claims, 5 Drawing Sheets

PIXEL COMPENSATION CIRCUIT AND DISPLAY DEVICE

1. FIELD OF THE DISCLOSURE

The present disclosure relates to the field of display, and more particularly, to a pixel compensation circuit and a display device.

2. DESCRIPTION OF RELATED ART

In the field of display devices, compared with liquid-crystal displays (LCDs), the advantages of organic light-emitting diode (OLED) display devices are wide color gamut, high contrast, energy-saving, foldability, etc. so the OLED display devices are extremely competitive among new-generation display devices. In addition, an active-matrix organic light-emitting diode (AMOLED) technique is one of developmental trends in flexible display. As FIG. 1 illustrates, an AMOLED display device of the related art includes a basic driving circuit. The basic driving circuit includes a switch thin-film transistor (TFT) T1, a driving TFT T2, and a storage capacitor Cst. A driving current of the OLED is controlled by the driving TFT T1. The driving current is $I_{OLED}=k(V_{gs}-V_{th})^2$ where k indicates the amplification coefficient of the driving TFT T1, which is determined by the property of the driving TFT T1 itself, and Vth indicates the threshold voltage of the driving TFT T1. Because the threshold voltage Vth of the driving TFT T1 drifts easily, the driving current of the OLED tends to be erratic, which affects the quality of a panel.

SUMMARY

An object of the present disclosure is to provide a pixel compensation circuit and a display device to avoid an erratic electric current of an organic light-emitting diode (OLED) due to a drift of a threshold voltage to improve the image quality of a panel.

According to one aspect of the present disclosure, a pixel compensation circuit includes:

a first switch, comprising a control terminal, a first terminal, and a second terminal; the first terminal of the first switch being connected to a first voltage terminal; the control terminal of the first switch being connected to a light-emitting control terminal;

a second switch, comprising a control terminal, a first terminal, and a second terminal; the control terminal of the second switch being connected to the second terminal of the second switch and the second terminal of the first switch; the first terminal of the second switch receiving a first reset signal;

a third switch, comprising a control terminal, a first terminal, and a second terminal; the control terminal of the third switch receiving a control signal; the first terminal of the third switch receiving a data signal;

a driving switch, comprising a control terminal, a first terminal, and a second terminal; the control terminal of the driving switch being connected to the second terminal of the third switch; the first terminal of the driving switch being connected to the second terminal of the first switch;

a fourth switch, comprising a control terminal, a first terminal, and a second terminal; the control terminal of the fourth switch receiving a first scanning signal; the first terminal of the fourth switch being connected to a second voltage terminal; the second terminal of the fourth switch being connected to the second terminal of the driving switch;

a fifth switch, comprising a control terminal, a first terminal, and a second terminal; the control terminal of the fifth switch T5 receiving a second scanning signal; the first terminal of the fifth switch being connected to the second terminal of the driving switch;

an organic light-emitting diode (OLED), comprising an anode and a cathode; the anode being connected to a second terminal of the fifth switch; the cathode being connected to a third voltage terminal;

a first capacitor, comprising a first terminal and a second terminal; the first terminal of the first capacitor being connected to the second terminal of the second switch; the second terminal of the first capacitor being connected to the second terminal of the third switch; and a second capacitor, comprising a first terminal and a second terminal; the first terminal of the second capacitor being connected to the second terminal of the second switch; the second terminal of the second capacitor being connected to a second reset signal, wherein the driving switch, the first switch, the second switch, the fourth switch, and the fifth switch are all p-channel metal-oxide semiconductor (PMOS) transistors; the control terminal, the first terminal, and the second terminal of the driving switch correspond to a gate, a drain, and a source of the PMOS transistor, respectively; the control terminal, the first terminal, and the second terminal of the first switch correspond to a gate, a drain, and a source of the PMOS transistor, respectively; the control terminal, the first terminal, and the second terminal of the second switch correspond to a gate, a drain, and a source of the PMOS transistor, respectively; the control terminal, the first terminal, and the second terminal of the fourth switch correspond to a gate, a drain, and a source of the PMOS transistor, respectively; the control terminal, the first terminal, and the second terminal of the fifth switch correspond to a gate, a drain, and a source of the PMOS transistor, respectively;

wherein the third switch is a PMOS transistor; the control signal received by the control terminal of the third switch is a third scanning signal scan; the control terminal, the first terminal, and the second terminal of the third switch correspond to a gate, a source, and a drain of the PMOS transistor, respectively.

According to another aspect of the present disclosure, a pixel compensation circuit includes:

a first switch, comprising a control terminal, a first terminal, and a second terminal; the first terminal of the first switch being connected to a first voltage terminal; the control terminal of the first switch being connected to a light-emitting control terminal;

a second switch, comprising a control terminal, a first terminal, and a second terminal; the control terminal of the second switch being connected to the second terminal of the second switch and the second terminal of the first switch; the first terminal of the second switch receiving a first reset signal;

a third switch, comprising a control terminal, a first terminal, and a second terminal; the control terminal of the third switch receiving a control signal; the first terminal of the third switch receiving a data signal;

a driving switch, comprising a control terminal, a first terminal, and a second terminal; the control terminal of the driving switch being connected to the second terminal of the third switch; the first terminal of the driving switch being connected to the second terminal of the first switch;

a fourth switch, comprising a control terminal, a first terminal, and a second terminal; the control terminal of the fourth switch receiving a first scanning signal; the first terminal of the fourth switch being connected to a second voltage terminal; the second terminal of the fourth switch being connected to the second terminal of the driving switch;

a fifth switch, comprising a control terminal, a first terminal, and a second terminal; the control terminal of the fifth switch T5 receiving a second scanning signal; the first terminal of the fifth switch being connected to the second terminal of the driving switch;

an organic light-emitting diode (OLED), comprising an anode and a cathode; the anode being connected to a second terminal of the fifth switch; the cathode being connected to a third voltage terminal;

a first capacitor, comprising a first terminal and a second terminal; the first terminal of the first capacitor being connected to the second terminal of the second switch; the second terminal of the first capacitor being connected to the second terminal of the third switch; and a second capacitor, comprising a first terminal and a second terminal; the first terminal of the second capacitor being connected to the second terminal of the second switch; the second terminal of the second capacitor being connected to a second reset signal.

According to still another aspect of the present disclosure, a display includes a pixel compensation circuit. The pixel compensation circuit includes:

a first switch, comprising a control terminal, a first terminal, and a second terminal; the first terminal of the first switch being connected to a first voltage terminal; the control terminal of the first switch being connected to a light-emitting control terminal;

a second switch, comprising a control terminal, a first terminal, and a second terminal; the control terminal of the second switch being connected to the second terminal of the second switch and the second terminal of the first switch; the first terminal of the second switch receiving a first reset signal;

a third switch, comprising a control terminal, a first terminal, and a second terminal; the control terminal of the third switch receiving a control signal; the first terminal of the third switch receiving a data signal;

a driving switch, comprising a control terminal, a first terminal, and a second terminal; the control terminal of the driving switch being connected to the second terminal of the third switch; the first terminal of the driving switch being connected to the second terminal of the first switch;

a fourth switch, comprising a control terminal, a first terminal, and a second terminal; the control terminal of the fourth switch receiving a first scanning signal; the first terminal of the fourth switch being connected to a second voltage terminal; the second terminal of the fourth switch being connected to the second terminal of the driving switch;

a fifth switch, comprising a control terminal, a first terminal, and a second terminal; the control terminal of the fifth switch T5 receiving a second scanning signal; the first terminal of the fifth switch being connected to the second terminal of the driving switch;

an organic light-emitting diode (OLED), comprising an anode and a cathode; the anode being connected to a second terminal of the fifth switch; the cathode being connected to a third voltage terminal;

a first capacitor, comprising a first terminal and a second terminal; the first terminal of the first capacitor being connected to the second terminal of the second switch; the second terminal of the first capacitor being connected to the second terminal of the third switch; and a second capacitor, comprising a first terminal and a second terminal; the first terminal of the second capacitor being connected to the second terminal of the second switch; the second terminal of the second capacitor being connected to a second reset signal.

The adoption of the present disclosure will bring some benefits. Compared with the related art, the pixel compensation circuit and a display device proposed by the present disclosure is reset through a second switch, retrieves and compensates for the threshold voltage of a driving switch through a first capacitor, and makes all the electric current flow out of a fourth switch without passing the OLED to prevent the OLED from emitting light spontaneously, thereby avoiding the electric current of the OLED from being erratic due to a drift of the threshold voltage so as to improve the image quality of the panel.

DETAILED DESCRIPTION OF THE EMBODIMENTS

Figure 1:
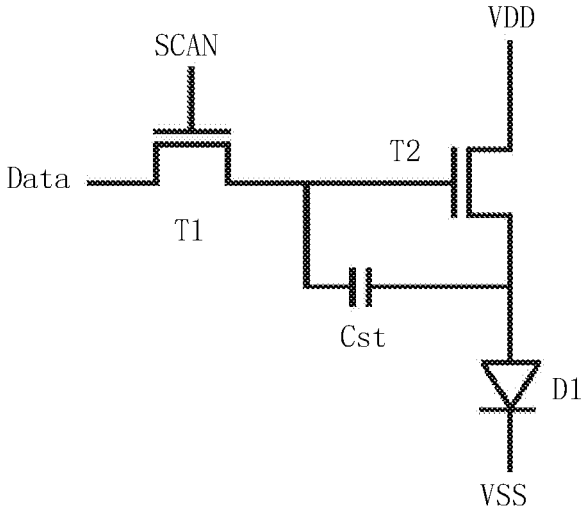
Fig. 1 (Related art)
FIG. 1 illustrates a circuit diagram of a driving circuit of a conventional display.
Figure 2:
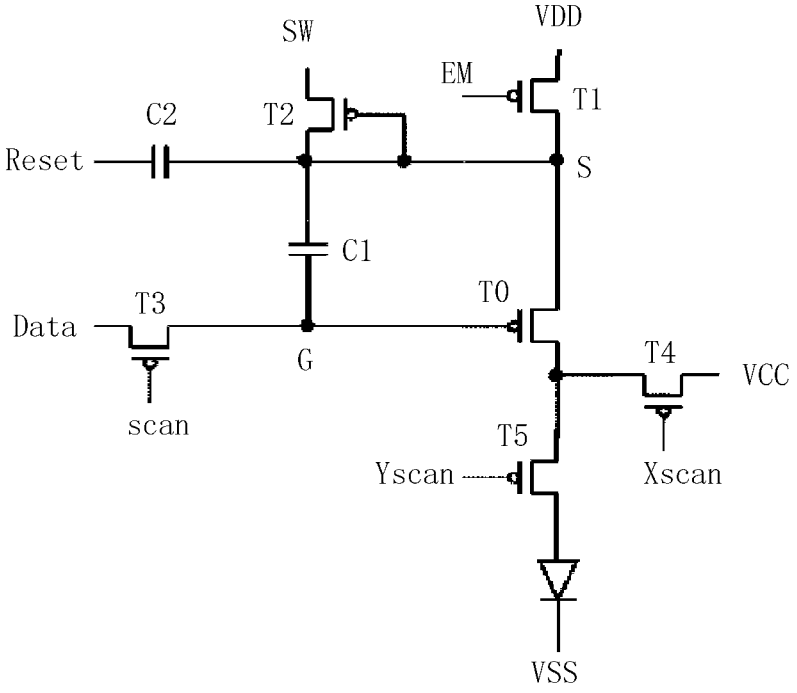
FIG. 2 is a circuit diagram of a pixel compensation circuit according to a first embodiment of the present disclosure.

FIG. 2 is a circuit diagram of a pixel compensation circuit according to a first embodiment of the present disclosure. The pixel compensation circuit includes a first switch T1, a second switch T2, a third switch T3, a driving switch T0, a fourth switch T4, a fifth switch T5, an organic light-emitting diode (OLED) D1, a first capacitor C1, and a second capacitor C2. The first switch T1 includes a control terminal, a first terminal, and a second terminal. The first terminal of the first switch T1 is connected to a first voltage terminal VDD. The control terminal of the first switch T1 is connected to a light-emitting control terminal EM.

The second switch T2 includes a control terminal, a first terminal, and a second terminal. The control terminal of the second switch T2 is connected to the second terminal of the second switch T2 and the second terminal of the first switch T1. The first terminal of the second switch T2 receives a first reset signal SW.

The third switch T3 includes a control terminal, a first terminal, and a second terminal. The control terminal of the third switch T3 receives a control signal. The first terminal of the third switch T3 receives a data signal Data.

The driving switch T0 includes a control terminal, a first terminal, and a second terminal. The control terminal of the driving switch T0 is connected to the second terminal of the third switch T3. The first terminal of the driving switch T0 is connected to the second terminal of the first switch T1.

The fourth switch T4 includes a control terminal, a first terminal, and a second terminal. The control terminal of the fourth switch T4 receives a first scanning signal Xscan. The first terminal of the fourth switch T4 is connected to a second voltage terminal VCC. The second terminal of the fourth switch T4 is connected to the second terminal of the driving switch T0.

The fifth switch T5 includes a control terminal, a first terminal, and a second terminal. The control terminal of the fifth switch T5 receives a second scanning signal Yscan. The first terminal of the fifth switch T5 is connected to the second terminal of the driving switch T0.

The OLED D1 includes an anode and a cathode. The anode is connected to a second terminal of the fifth switch T5. The cathode is connected to a third voltage terminal VSS.

The first capacitor C1 includes a first terminal and a second terminal. The first terminal of the first capacitor C1 is connected to the second terminal of the second switch T2. The second terminal of the first capacitor C1 is connected to the second terminal of the third switch T3. The second capacitor C2 includes a first terminal and a second terminal. The first terminal of the second capacitor C2 is connected to the second terminal of the second switch T2. The second terminal of the second capacitor C2 is connected to a second reset signal Reset.

In this embodiment, the driving switch T0, the first switch T1, the second switch T2, the fourth switch T4, and the fifth switch T5 are all p-channel metal-oxide semiconductor (PMOS) transistors. The control terminal, the first terminal, and the second terminal of the driving switch T0 correspond to a gate, a drain, and a source of the PMOS transistor, respectively. The control terminal, the first terminal, and the second terminal of the first switch T1 correspond to a gate, a drain, and a source of the PMOS transistor, respectively. The control terminal, the first terminal, and the second terminal of the second switch T2 correspond to a gate, a drain, and a source of the PMOS transistor, respectively. The control terminal, the first terminal, and the second terminal of the fourth switch T4 correspond to a gate, a drain, and a source of the PMOS transistor, respectively. The control terminal, the first terminal, and the second terminal of the fifth switch T5 correspond to a gate, a drain, and a source of the PMOS transistor, respectively.

In this embodiment, the third switch T3 is a PMOS transistor. The control signal received by the control terminal of the third switch T3 is a third scanning signal scan. The control terminal, the first terminal, and the second terminal of the third switch T3 correspond to a gate, a source, and a drain of the PMOS transistor, respectively.

In this embodiment, a voltage set value of the second voltage terminal VCC is less than a voltage set value of the third voltage terminal VSS. The OLED D1 is an active-matrix organic light-emitting diode (AMOLED). The first capacitor C1 and the second capacitor C2 are both storage capacitors.

Figure 3:
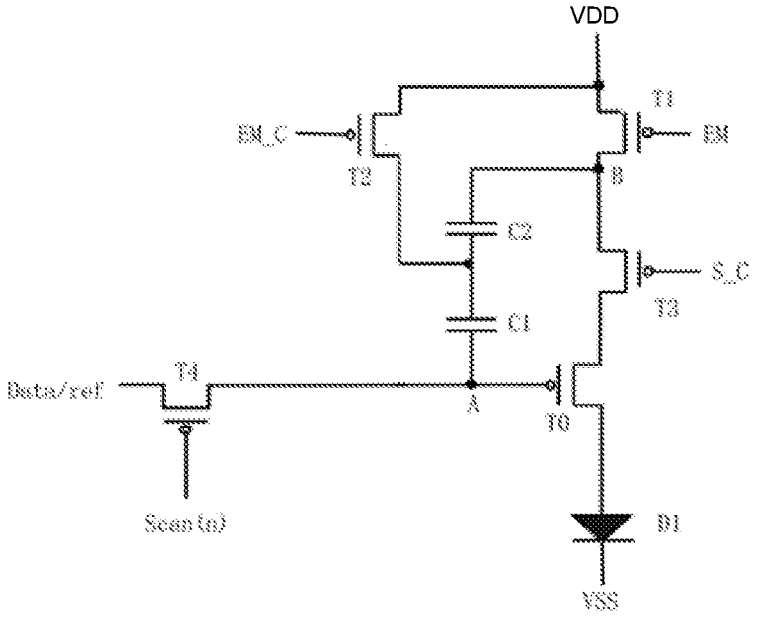
FIG. 3 illustrates a timing diagram of signals applied on the pixel compensation circuit shown in FIG. 2.
Figure 4:
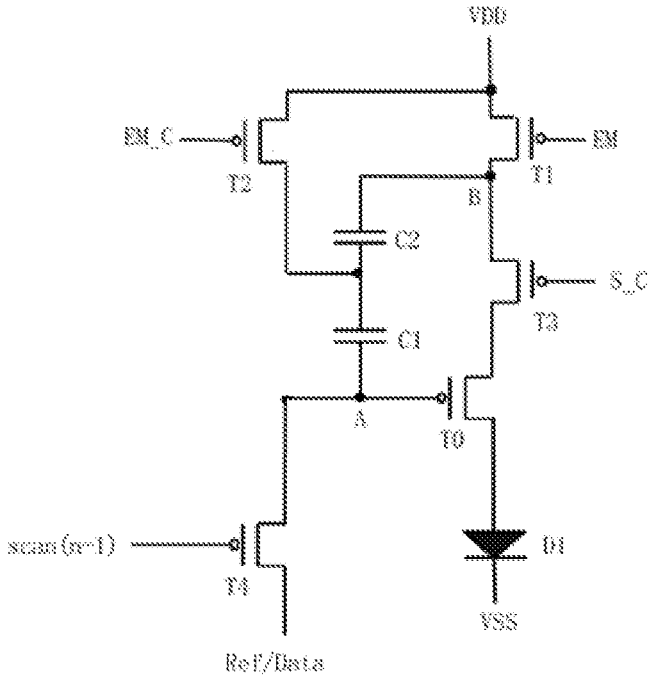
FIG. 4 illustrates waveforms of set timing applied to the pixel compensation circuit shown in FIG. 2.

As FIG. 2 to FIG. 4 illustrate, the operating principle of the pixel compensation circuit is divided into a reset stage, a compensation stage, a data write-in stage, and a light-emitting stage.

At reset stage: The second switch T2 is turned on. The electric potential of a S-node is raised to Vs=Vsw+Vth through the second switch T2 where Vsw indicates the voltage output by the first reset signal SW, and Vth indicates the threshold voltage of the second switch T2. At this time, the electric potential of the second reset signal Reset turns into a high voltage level from a voltage level. The electric potential of a G-node is Vg=Vref where Vref indicates the reference voltage.

At compensation stage: When the electric potential of the second reset signal Reset turns into high voltage level from low voltage level, the electric potential of the S node is further raised high through a coupling effect of the second charge C2. At this time, when the driving switch T0 is turned on and the difference of the electric potential is stored in the first charge C1, the first charge C1 starts to discharge to the S node with the electric potential as Vs=Vref-Vth where Vref indicates the reference voltage, and Vth indicates the threshold voltage of the driving switch T0. The driving switch T0 turns off. The threshold voltage Vth of the driving switch T0 is stored in the first charge C1. Meanwhile, the fourth switch T4 is turned on, and the fifth switch T5 is turned off. During the process of retrieving the threshold voltage Vth of the driving switch T0, all the electric current is flown out of the fourth switch T4 to avoid the OLED D1 to emit light spontaneously.

At data write-in stage: The third switch T3 is turned on, and the fourth switch T4 and the fifth switch T5 are turned off. At this time, the electric potential of the G-node is Vg=Vdata where Vdata indicates the output voltage of the data signal. The operation of the first capacitor C1 and the second capacitor C2 connected in series makes the electric potential of the S-node to be Vs=[C2/(C1+C2)]*Vref+[C1/(C1+C2)]*Vdata−Vth where C1 indicates the capacitive value of the first capacitor C1, C2 indicates the capacitive value of the second capacitor C2, Vref indicates the reference value, Vdata indicates the data voltage of the data signal, and Vth indicates the threshold voltage of the driving switch T0. Therefore, Vgs=Vg−Vs=[C2/(C1+C2)]*(Vdata−Vref)+Vth stands because the electric current passing the OLED D1 is $I=K*(Vgs-Vth)^2$ where K indicates the amplification coefficient of the electric current of the driving switch T0. Therefore, $I=K*[C2/(C1+C2)]^2*(Vdata-Vref)^2$ stands.

At light-emitting stage: The first switch T1 and the fifth switch T5 are both turned on. The second switch T2, the third switch T3, and the fourth switch T4 are all terminated. The OLED D1 emits light.

The pixel compensation circuit resets the S node through the second switch T2 and retrieves and compensates for the threshold voltage Vth of the driving switch T0 through a discharge of the first capacitor C1. Moreover, all the electric current is flown out of the fourth switch T4 without passing the OLED D1 at the compensation stage to prevent the OLED D1 from emitting light spontaneously, thereby avoiding the electric current of the OLED D1 from being erratic due to a drift of the threshold voltage to improve the image quality of the panel.

Figure 5:
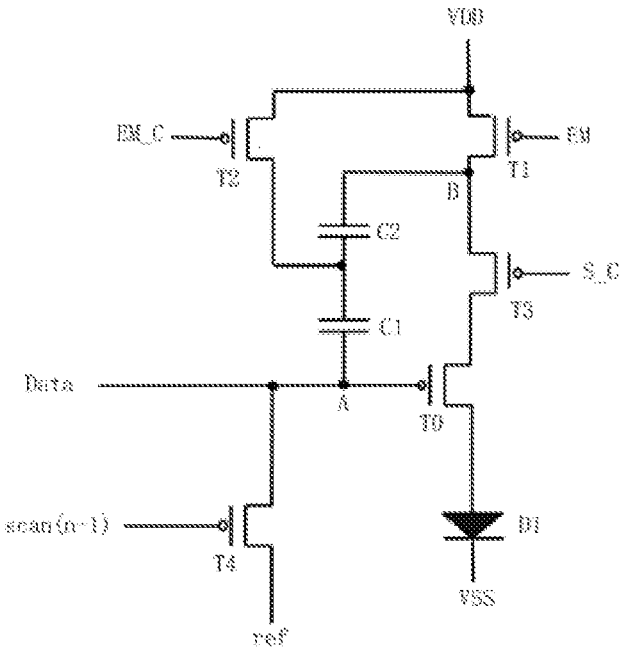
FIG. 5 is a simulated waveform of signals applied to the pixel compensation circuit shown in FIG. 2.

FIG. 5 is a simulated waveform graph of the pixel compensation circuit according to the embodiment of the present disclosure. As FIG. 5 illustrates, the pixel compensation circuit retrieves the threshold voltage Vth of the driving switch T0 through a discharge of the S node. When the threshold voltage Vth is retrieved, all the electric current is flown out of the fourth switch T4 without passing the OLED D1 to prevent the OLED D1 from emitting light spontaneously, thereby avoiding the electric current of the OLED D1 from being erratic due to the shift of the threshold voltage to improve the image quality of the panel.

Figure 6:
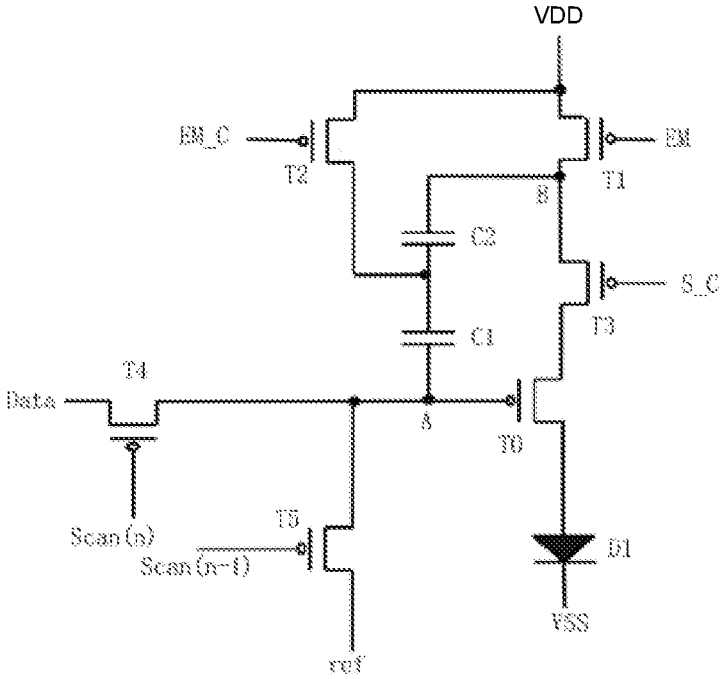
FIG. 6 is a circuit diagram of a pixel compensation circuit according to a second embodiment of the present disclosure.

FIG. 6 is a circuit diagram of a pixel compensation circuit according to a second embodiment of the present disclosure. Differing from the pixel compensation circuit introduced in the first embodiment, in the present embodiment a third switch T3 is an n-channel metal-oxide semiconductor (NMOS) transistor. A control signal received by a control terminal of a third switch T3 is a control signal output by a light-emitting control terminal EM. The control terminal, a first terminal, and a second terminal of the third switch T3 correspond to a gate, a source, and a drain of the NMOS transistor, respectively.

Figure 7:
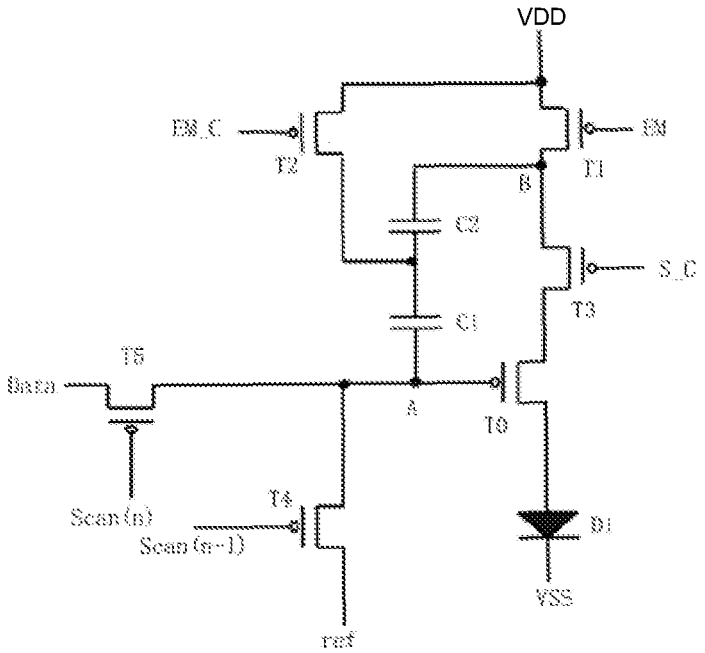
FIG. 7 illustrates a timing diagram of signals applied on the pixel compensation circuit shown in FIG. 6.
Figure 8:
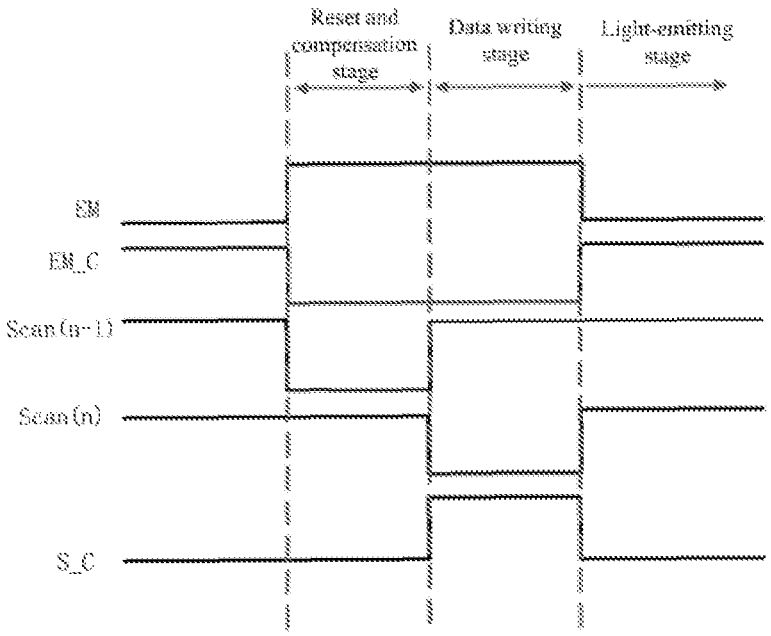
FIG. 8 illustrates waveforms of set timing applied to the pixel compensation circuit shown in FIG. 6.

As FIG. 6 to FIG. 8 illustrates, the operating principle of the pixel compensation circuit is divided into a reset stage, a compensation stage, a data write-in stage, and a light-emitting stage.

At reset stage: The second switch T2 is turned on. The electric potential of a S-node voltage level is raised to Vs=Vsw+Vth through the second switch T2 where Vsw indicates the voltage output by a first reset signal SW, and Vth indicates the threshold voltage of a second switch T2. At this time, the electric potential of a second reset signal Reset turns into a high voltage level from a voltage level. The electric potential of a G-node is Vg=Vref where Vref indicates the reference voltage.

At compensation stage: When the electric potential of the second reset signal Reset turns into high voltage level from low voltage level, the electric potential of the S node is further raised high through a coupling effect of the second charge C2. At this time, when the driving switch T0 is turned on and the difference of the electric potential is stored in the first charge C1, the first charge C1 starts to discharge to the S node with the electric potential as Vs=Vref−Vth where Vref indicates the reference voltage, and Vth indicates the threshold voltage of the driving switch T0. The driving switch T0 is turn off. The threshold voltage Vth of the driving switch T0 is stored in the first charge C1. Meanwhile, the fourth switch T4 is turned on, and the fifth switch T5 is turned off. During the process of retrieving the threshold voltage Vth of the driving switch T0, all the electric current is flown out of the fourth switch T4 to prevent an organic light-emitting diode (OLED) D1 from emitting light spontaneously.

At write-in stage: The third switch T3 is turned on, and the fourth switch T4 and the fifth switch T5 are turned off. At this time, the electric potential of the G-node is Vg=Vdata where Vdata indicates the output voltage of a data signal. The operation of the first capacitor C1 and the second capacitor C2 connected in series makes the electric potential of the S-node to be Vs=[C2/(C1+C2)]*Vref+[C1/(C1+C2)]*Vdata−Vth where C1 indicates the capacitive value of the first capacitor, C2 indicates the capacitive value of the second capacitor, Vref indicates the reference value, Vdata indicates the data voltage of the data signal, and Vth indicates the threshold voltage of the driving switch T0. Therefore, Vgs=Vg−Vs=[C2/(C1+C2)]*(Vdata−Vref)+Vth stands because the electric current passing the OLED D1 is $I=K*(Vgs-Vth)^2$ where K indicates the amplification coefficient of the electric current of the driving switch T0. Therefore, $I=K*[C2/(C1+C2)]^2*(Vdata-Vref)^2$ stands.

At light-emitting stage: The first switch T1 and the fifth switch T5 are both turned on. The second switch T2, the third switch T3, and the switch T4 are all terminated. The OLED D1 emits light.

The pixel compensation circuit resets the S node through the second switch T2 and retrieves and compensates for the threshold voltage Vth of the driving switch T0 through the discharge of the first capacitor C1. Moreover, all the electric current is flown out of the fourth switch T4 without passing the OLED D1 at the compensation stage to prevent the OLED D1 from emitting light spontaneously, thereby avoiding the electric current of the OLED D1 from being erratic due to a shift of the threshold voltage to improve the image quality of the panel.

Figure 9:
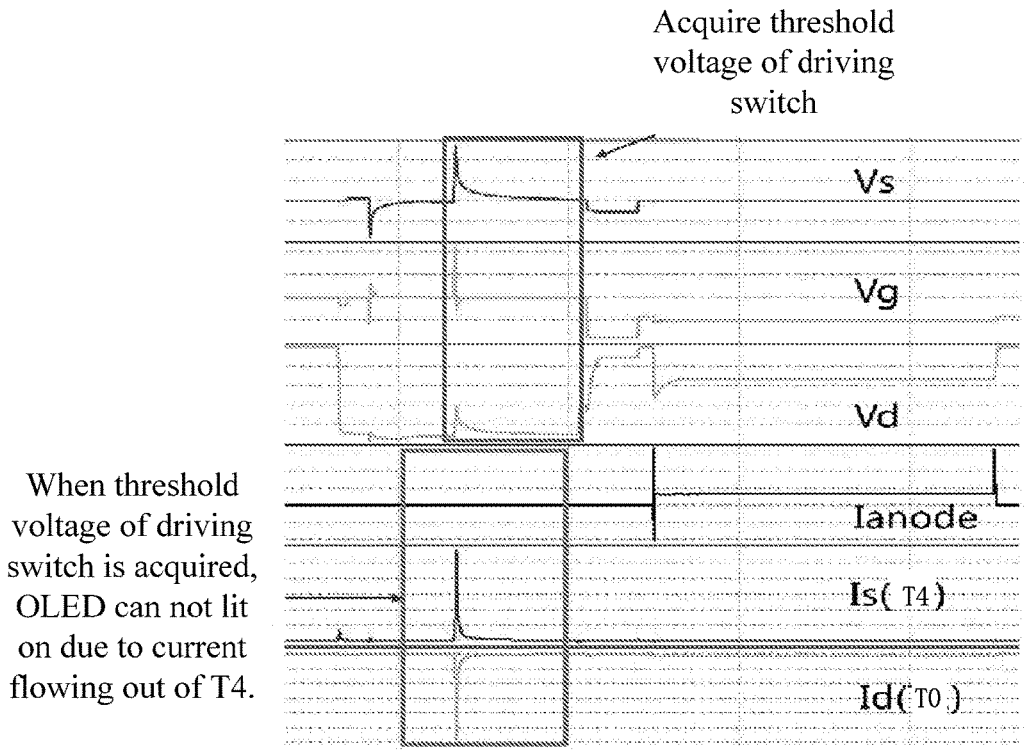
FIG. 9 is a simulated waveform of signals applied to the pixel compensation circuit shown in FIG. 6.

FIG. 9 is a simulated waveform graph of the pixel compensation circuit according to the embodiment of the present disclosure. As FIG. 9 illustrates, the pixel compensation circuit retrieves the threshold voltage Vth of the driving switch T0 through the discharge of the S node. Moreover, all the electric current is flown out of the fourth switch T4 without passing the OLED D1 to prevent the OLED D1 from emitting light spontaneously, thereby avoiding the electric current of the OLED D1 from being erratic due to the shift of the threshold voltage to improve the image quality of the panel. As FIG. 6 illustrates, the control terminal of the third switch T3 and a control terminal of the first switch T1 in the pixel compensation circuit are both connected to the emitting control terminal to the emitting terminal so as to reduce the number of the signal lines to facilitate the development of the product.

Figure 10:
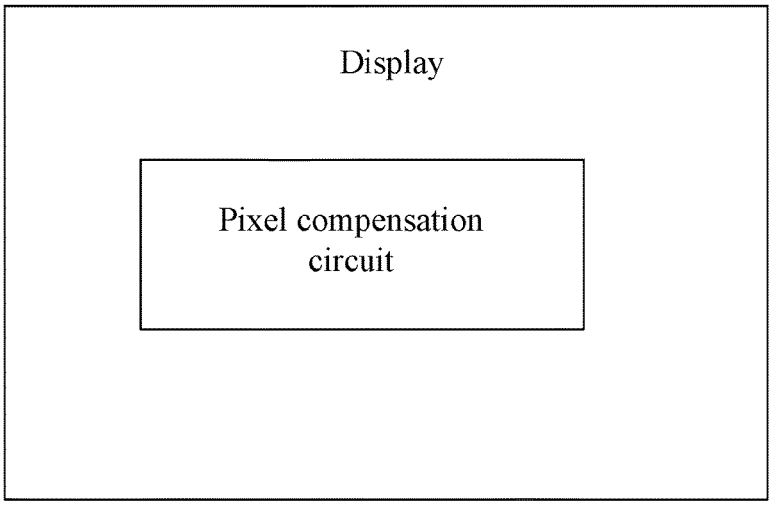
FIG. 10 is a schematic diagram of the structure of a display device according to another embodiment of the present disclosure.

FIG. 10 is a schematic diagram of the structure of a display device according to another embodiment of the present disclosure. The display device includes any one of the pixel compensation circuits introduced in the aforementioned embodiments. Other devices and functions of the display device are the same as devices and functions of the display device of related art so the present embodiment will not go into detail.

The pixel compensation circuit and the display device are reset through the second switch. The threshold voltage of the driving switch retrieved by the discharge of the first capacitor is compensated. Moreover, all the electric current is flown out of the fourth switch without passing the OLED D1 at the compensation stage to prevent the OLED D1 from emitting light spontaneously, thereby avoiding the electric current of the OLED D1 from being erratic due to the shift of the threshold voltage to improve the image quality of the panel.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A pixel compensation circuit, comprising a first switch, comprising a control terminal, a first terminal, and a second terminal; the first terminal of the first switch being connected to a first voltage terminal; the control terminal of the first switch being connected to a light-emitting control terminal;

a second switch, comprising a control terminal, a first terminal, and a second terminal; the control terminal of the second switch being connected to the second terminal of the second switch and the second terminal of the first switch; the first terminal of the second switch receiving a first reset signal;

a third switch, comprising a control terminal, a first terminal, and a second terminal; the control terminal of the third switch receiving a control signal; the first terminal of the third switch receiving a data signal;

a driving switch, comprising a control terminal, a first terminal, and a second terminal; the control terminal of the driving switch being connected to the second terminal of the third switch; the first terminal of the driving switch being connected to the second terminal of the first switch;

a fourth switch, comprising a control terminal, a first terminal, and a second terminal; the control terminal of the fourth switch receiving a first scanning signal; the first terminal of the fourth switch being connected to a second voltage terminal; the second terminal of the fourth switch being connected to the second terminal of the driving switch;

a fifth switch, comprising a control terminal, a first terminal, and a second terminal; the control terminal of the fifth switch receiving a second scanning signal; the first terminal of the fifth switch being connected to the second terminal of the driving switch;

an organic light-emitting diode (OLED), comprising an anode and a cathode; the anode being connected to a second terminal of the fifth switch; the cathode being connected to a third voltage terminal;

a first capacitor, comprising a first terminal and a second terminal; the first terminal of the first capacitor being connected to the second terminal of the second switch; the second terminal of the first capacitor being connected to the second terminal of the third switch; and a second capacitor, comprising a first terminal and a second terminal; the first terminal of the second capacitor being connected to the second terminal of the second switch; the second terminal of the second capacitor being connected to a second reset signal, wherein the driving switch, the first switch, the second switch, the fourth switch, and the fifth switch are all p-channel metal-oxide semiconductor (PMOS) transistors; the control terminal, the first terminal, and the second terminal of the driving switch correspond to a gate, a drain, and a source of the PMOS transistor, respectively; the control terminal, the first terminal, and the second terminal of the first switch correspond to a gate, a drain, and a source of the PMOS transistor, respectively; the control terminal, the first terminal, and the second terminal of the second switch correspond to a gate, a drain, and a source of the PMOS transistor, respectively; the control terminal, the first terminal, and the second terminal of the fourth switch correspond to a gate, a drain, and a source of the PMOS transistor, respectively; the control terminal, the first terminal, and the second terminal of the fifth switch correspond to a gate, a drain, and a source of the PMOS transistor, respectively;

wherein the third switch is a PMOS transistor; the control signal received by the control terminal of the third switch is a third scanning signal; the control terminal, the first terminal, and the second terminal of the third switch correspond to a gate, a source, and a drain of the PMOS transistor, respectively.

2. A pixel compensation circuit, comprising a first switch, comprising a control terminal, a first terminal, and a second terminal; the first terminal of the first switch being connected to a first voltage terminal; the control terminal of the first switch being connected to a light-emitting control terminal;

a second switch, comprising a control terminal, a first terminal, and a second terminal; the control terminal of the second switch being connected to the second terminal of the second switch and the second terminal of the first switch; the first terminal of the second switch receiving a first reset signal;

a third switch, comprising a control terminal, a first terminal, and a second terminal; the control terminal of the third switch receiving a control signal; the first terminal of the third switch receiving a data signal;

a driving switch, comprising a control terminal, a first terminal, and a second terminal; the control terminal of the driving switch being connected to the second terminal of the third switch; the first terminal of the driving switch being connected to the second terminal of the first switch;

a fourth switch, comprising a control terminal, a first terminal, and a second terminal; the control terminal of the fourth switch receiving a first scanning signal; the first terminal of the fourth switch being connected to a second voltage terminal; the second terminal of the fourth switch being connected to the second terminal of the driving switch;

a fifth switch, comprising a control terminal, a first terminal, and a second terminal; the control terminal of the fifth switch receiving a second scanning signal; the first terminal of the fifth switch being connected to the second terminal of the driving switch;

an organic light-emitting diode (OLED), comprising an anode and a cathode; the anode being connected to a second terminal of the fifth switch; the cathode being connected to a third voltage terminal;

a first capacitor, comprising a first terminal and a second terminal; the first terminal of the first capacitor being connected to the second terminal of the second switch; the second terminal of the first capacitor being connected to the second terminal of the third switch; and a second capacitor, comprising a first terminal and a second terminal; the first terminal of the second capacitor being connected to the second terminal of the second switch; the second terminal of the second capacitor being connected to a second reset signal.

3. The pixel compensation circuit of claim 2, wherein the driving switch, the first switch, the second switch, the fourth switch, and the fifth switch are all p-channel metal-oxide semiconductor (PMOS) transistors; the control terminal, the first terminal, and the second terminal of the driving switch correspond to a gate, a drain, and a source of the PMOS transistor, respectively; the control terminal, the first terminal, and the second terminal of the first switch correspond to a gate, a drain, and a source of the PMOS transistor, respectively; the control terminal, the first terminal, and the second terminal of the second switch correspond to a gate, a drain, and a source of the PMOS transistor, respectively; the control terminal, the first terminal, and the second terminal of the fourth switch correspond to a gate, a drain, and a source of the PMOS transistor, respectively; the control terminal, the first terminal, and the second terminal of the fifth switch correspond to a gate, a drain, and a source of the PMOS transistor, respectively.

4. The pixel compensation circuit of claim 2, wherein the third switch is a PMOS transistor; the control signal received by the control terminal of the third switch is a third scanning signal; the control terminal, the first terminal, and the second terminal of the third switch correspond to a gate, a source, and a drain of the PMOS transistor, respectively.

5. The pixel compensation circuit of claim 2, wherein the third switch is an n-channel metal-oxide semiconductor (NMOS) transistor; the control signal received by the control terminal of the third switch is a control signal output by the light-emitting control terminal; the control terminal, the first terminal, and the second terminal of the third switch correspond to a gate, a source, and a drain of the NMOS transistor, respectively.

6. The pixel compensation circuit of claim 2, wherein a voltage set value of the second voltage terminal is less than a voltage set value of the third voltage terminal; the OLED is an active-matrix organic light-emitting diode (AMOLED); the first capacitor and the second capacitor are both storage capacitors.

7. A display, comprising a pixel compensation circuit, the pixel compensation circuit comprising:

a first switch, comprising a control terminal, a first terminal, and a second terminal; the first terminal of the first switch being connected to a first voltage terminal; the control terminal of the first switch being connected to a light-emitting control terminal;

a second switch, comprising a control terminal, a first terminal, and a second terminal; the control terminal of the second switch being connected to the second terminal of the second switch and the second terminal of the first switch; the first terminal of the second switch receiving a first reset signal;

a third switch, comprising a control terminal, a first terminal, and a second terminal; the control terminal of the third switch receiving a control signal; the first terminal of the third switch receiving a data signal;

a driving switch, comprising a control terminal, a first terminal, and a second terminal; the control terminal of the driving switch being connected to the second terminal of the third switch; the first terminal of the driving switch being connected to the second terminal of the first switch;

a fourth switch, comprising a control terminal, a first terminal, and a second terminal; the control terminal of the fourth switch receiving a first scanning signal; the first terminal of the fourth switch being connected to a second voltage terminal; the second terminal of the fourth switch being connected to the second terminal of the driving switch;

a fifth switch, comprising a control terminal, a first terminal, and a second terminal; the control terminal of the fifth switch receiving a second scanning signal; the first terminal of the fifth switch being connected to the second terminal of the driving switch;

an organic light-emitting diode (OLED), comprising an anode and a cathode; the anode being connected to a second terminal of the fifth switch; the cathode being connected to a third voltage terminal;

a first capacitor, comprising a first terminal and a second terminal; the first terminal of the first capacitor being connected to the second terminal of the second switch; the second terminal of the first capacitor being connected to the second terminal of the third switch; and a second capacitor, comprising a first terminal and a second terminal; the first terminal of the second capacitor being connected to the second terminal of the second switch; the second terminal of the second capacitor being connected to a second reset signal.

8. The display of claim 7, wherein the driving switch, the first switch, the second switch, the fourth switch, and the fifth switch are all p-channel metal-oxide semiconductor (PMOS) transistors; the control terminal, the first terminal, and the second terminal of the driving switch correspond to a gate, a drain, and a source of the PMOS transistor, respectively; the control terminal, the first terminal, and the second terminal of the first switch correspond to a gate, a drain, and a source of the PMOS transistor, respectively; the control terminal, the first terminal, and the second terminal of the second switch correspond to a gate, a drain, and a source of the PMOS transistor, respectively; the control terminal, the first terminal, and the second terminal of the fourth switch correspond to a gate, a drain, and a source of the PMOS transistor, respectively; the control terminal, the first terminal, and the second terminal of the fifth switch correspond to a gate, a drain, and a source of the PMOS transistor, respectively.

9. The display of claim 7, wherein the third switch is a PMOS transistor; the control signal received by the control terminal of the third switch is a third scanning signal; the control terminal, the first terminal, and the second terminal of the third switch correspond to a gate, a source, and a drain of the PMOS transistor, respectively.

10. The display of claim 7, wherein the third switch is an n-channel metal-oxide semiconductor (NMOS) transistor; the control signal received by the control terminal of the third switch is a control signal output by the light-emitting control terminal; the control terminal, the first terminal, and the second terminal of the third switch correspond to a gate, a source, and a drain of the NMOS transistor, respectively.

11. The display of claim 7, wherein a voltage set value of the second voltage terminal is less than a voltage set value of the third voltage terminal; the OLED is an active-matrix organic light-emitting diode (AMOLED); the first capacitor and the second capacitor are both storage capacitors.

* * * * *